US009091455B1

(12) United States Patent
Coster

(10) Patent No.: US 9,091,455 B1
(45) Date of Patent: Jul. 28, 2015

(54) SWAMP COOLER BLOWER FAN HOLE COVER

(76) Inventor: Jan B. Coster, Wheat Ridge, CO (US)

( * ) Notice: Subject to any disclaimer, the term of this patent is extended or adjusted under 35 U.S.C. 154(b) by 607 days.

(21) Appl. No.: 13/317,148

(22) Filed: Oct. 12, 2011

(51) Int. Cl.
*F24F 13/20* (2006.01)
*F24F 13/08* (2006.01)
*B63B 21/12* (2006.01)

(52) U.S. Cl.
CPC *F24F 13/08* (2013.01); *B63B 21/12* (2013.01)

(58) Field of Classification Search
CPC ..... A62B 11/00; A62B 13/00; F24F 2221/52; A01G 9/14; A01G 9/24; A01G 9/146
USPC ..... 454/264; D23/393, 373, 374, 386, 499, D23/262, 269
See application file for complete search history.

(56) References Cited

U.S. PATENT DOCUMENTS

D30,905 S * 5/1899 Ladd ..... D23/374
D32,089 S * 1/1900 Brown ..... D16/235
745,313 A * 12/1903 Bate ..... 49/41
1,055,232 A * 3/1913 Russell ..... 110/184
1,373,597 A * 4/1921 Carey ..... 114/221 R
1,401,540 A * 12/1921 Konig ..... 114/221 R
1,486,417 A * 3/1924 Cheely ..... 114/221 R
1,534,875 A * 4/1925 Siday ..... 422/125
1,553,254 A * 9/1925 Mallu ..... 114/221 R
1,641,081 A * 8/1927 Heymann ..... 114/221 R
1,687,645 A * 10/1928 Diederich ..... 454/152
1,744,834 A * 1/1930 Maynard ..... 114/221 R
1,763,282 A * 6/1930 Vining ..... 454/351
1,786,203 A * 12/1930 Gilbert ..... 454/210
1,933,910 A * 11/1933 Hueglin ..... 454/343
2,010,809 A * 8/1935 Braine ..... 454/205
2,021,684 A * 11/1935 Faber ..... 454/210
2,035,234 A * 3/1936 Hoper ..... 454/155
2,051,613 A * 8/1936 MacLeod ..... 454/206
2,055,621 A * 9/1936 Chamberlin ..... 454/202
2,210,658 A * 8/1940 Fassman ..... 114/221 R
2,228,224 A * 1/1941 Benson ..... 454/210
2,241,753 A * 5/1941 Whitlark ..... 165/41

(Continued)

FOREIGN PATENT DOCUMENTS

WO WO2011022252 A2 * 2/2011

OTHER PUBLICATIONS

Winterizing a Swamp Cooler, Aug. 2006, http://www.doityourself.com/forum/evaporative-water-coolers/70776-fyi-winterizing-swamp-cooler.html#b.*

(Continued)

*Primary Examiner* — Gregory Huson
*Assistant Examiner* — Martha Becton
(74) *Attorney, Agent, or Firm* — Edwin H. Crabtree; Ramon L. Pizarro

(57) ABSTRACT

A swamp cooler blower fan hole cover used to prevent heat loss from a building and through the swamp cooler blower fan housing. The cover includes an annular shaped, cover member. The cover member is dimensioned to cover a fan hole in a fan housing. The cover member includes two foldable side tabs. The side tabs are folded when slipped under shaft bearing support arms attached to the sides of the fan hole. The cover member includes a center hole with center hole tabs for receipt around a drive shaft. From the center hole of the cover member is a radius cut with fold lines folded outwardly when the center hole and tabs are received around the drive shaft.

2 Claims, 2 Drawing Sheets

(56) References Cited

U.S. PATENT DOCUMENTS 2,284,905 A * 6/1942 Jackson ..... 34/72
2,421,151 A * 5/1947 Johnstone et al. ..... 114/221 R
2,459,060 A * 1/1949 Bush ..... 114/221 R
2,493,107 A * 1/1950 Bush ..... 114/221 R
2,525,234 A * 10/1950 Mucke ..... 114/221 R
2,547,189 A * 4/1951 Welch, Sr. ..... 454/210
2,559,495 A * 7/1951 Calkins ..... 454/205
2,584,933 A * 2/1952 Spear ..... 454/354
2,592,174 A * 4/1952 O'Connell ..... 454/200
2,617,378 A * 11/1952 Osol ..... 114/221 R
2,622,730 A * 12/1952 Sharp, Jr. ..... 206/297
2,626,479 A * 1/1953 Marrits ..... 281/44
2,682,826 A * 7/1954 Wahlborg ..... 454/350
2,684,621 A * 7/1954 Cook ..... 454/352
2,705,990 A * 4/1955 Miller ..... 150/165
2,711,769 A * 6/1955 Katcher et al. ..... 150/165
2,714,546 A * 8/1955 Lesniak ..... 52/125.2
2,720,236 A * 10/1955 Hoffman ..... 150/165
2,777,405 A * 1/1957 Ager ..... 52/16
2,779,610 A * 1/1957 Risley ..... 285/323
2,839,080 A * 6/1958 Copeland ..... 137/625.4
2,959,147 A * 11/1960 Reubenstine ..... 114/221 R
2,985,447 A * 5/1961 Braskamp ..... 49/347
2,992,668 A * 7/1961 Collard ..... 150/165
3,005,436 A * 10/1961 Caldwell ..... 114/221 R
3,006,498 A * 10/1961 Thiede et al. ..... 220/255
3,016,034 A * 1/1962 Raistakka ..... 114/221 R
3,035,374 A * 5/1962 Allen ..... 52/289
3,056,375 A * 10/1962 Bernhard ..... 114/221 R
3,064,984 A * 11/1962 Mickle et al. ..... 277/606
3,072,041 A * 1/1963 Downing ..... 454/200
3,095,178 A * 6/1963 Veber ..... 251/212
3,105,664 A * 10/1963 Poradun ..... 248/56
3,143,953 A * 8/1964 Bristol ..... 454/352
3,160,987 A * 12/1964 Pinkley ..... 52/95
3,187,523 A * 6/1965 Kilbourn ..... 431/347
3,194,203 A * 7/1965 Thornton ..... 114/221 R
3,211,177 A * 10/1965 Phillips et al. ..... 137/896
3,263,906 A * 8/1966 Ward ..... 415/146
3,320,996 A * 5/1967 Singer ..... 150/165
3,334,569 A * 8/1967 Lambie ..... 454/352
3,379,481 A * 4/1968 Fisher ..... 312/100
3,388,520 A * 6/1968 Perry ..... 52/511
D211,826 S * 7/1968 Hamrick ..... D32/31
D215,003 S * 8/1969 Stevens et al. ..... D23/393
3,472,150 A * 10/1969 Strawsine ..... 454/353
3,484,037 A * 12/1969 Kugler ..... 383/21
3,661,323 A * 5/1972 Farris ..... 236/93 R
3,677,517 A * 7/1972 Root et al. ..... 251/366
3,683,785 A * 8/1972 Grange ..... 454/250
3,706,290 A * 12/1972 Holland ..... 110/184
3,741,290 A * 6/1973 Nenadal ..... 165/48.1
3,748,997 A * 7/1973 Dean et al. ..... 454/234
D231,356 S * 4/1974 Kurz ..... D23/393
3,831,321 A * 8/1974 Johnson ..... 49/465
3,863,553 A * 2/1975 Koontz ..... 454/260
3,894,527 A * 7/1975 Ickes ..... 126/545
D239,118 S * 3/1976 Branson ..... D13/179
4,069,628 A * 1/1978 Kreimer ..... 52/94
4,073,597 A * 2/1978 Barnhart et al. ..... 415/201
4,094,492 A * 6/1978 Beeman et al. ..... 251/212
4,096,790 A * 6/1978 Curran ..... 454/260
D248,770 S * 8/1978 Michaelsen ..... D23/386
4,108,238 A * 8/1978 Vary et al. ..... 165/57
4,125,971 A * 11/1978 Ward ..... 52/95
4,125,982 A * 11/1978 Ward ..... 52/404.1
4,152,844 A * 5/1979 Materniak et al. ..... 34/235
4,159,403 A * 6/1979 Sangster ..... 379/450
4,170,880 A * 10/1979 Lou ..... 62/262
4,185,433 A * 1/1980 Cantrell ..... 52/94
4,200,117 A * 4/1980 Anderson et al. ..... 137/512.1
4,202,389 A * 5/1980 Ewald ..... 150/165
4,232,595 A * 11/1980 Cox ..... 454/29
4,234,526 A * 11/1980 Mackay et al. ..... 261/106
4,261,930 A * 4/1981 Walker ..... 261/92
4,308,905 A * 1/1982 Gallagher ..... 150/165
D263,866 S * 4/1982 Messenger ..... D23/269
4,332,114 A * 6/1982 Goebel et al. ..... 62/262
D266,357 S * 9/1982 Ward ..... D23/393
4,374,534 A * 2/1983 Jespers et al. ..... 52/3
4,376,082 A * 3/1983 Heck ..... 261/127
4,379,712 A * 4/1983 Sperr et al. ..... 96/294
D269,043 S * 5/1983 Resnicoff et al. ..... D25/48.7
4,407,188 A * 10/1983 Thorn ..... 454/351
D274,935 S * 7/1984 Tanges, Jr. ..... D23/373
D277,131 S * 1/1985 Shames et al. ..... D23/393
4,498,912 A * 2/1985 Wagner ..... 55/486
D281,194 S * 10/1985 Artwick ..... D23/390
D281,273 S * 11/1985 Artwick ..... D23/390
4,570,564 A * 2/1986 Salvarezza ..... 114/221 R
4,581,861 A * 4/1986 Eury ..... 52/95
4,625,784 A * 12/1986 Boroson ..... 150/165
4,732,012 A * 3/1988 Thorpe ..... 62/304
4,745,769 A * 5/1988 Wooden, Jr. ..... 62/259.1
4,759,194 A * 7/1988 Shapiro ..... 62/262
4,760,773 A * 8/1988 Pezzulli ..... 454/358
4,788,805 A * 12/1988 Shaw ..... 52/202
4,794,852 A * 1/1989 Ee ..... 454/271
4,815,530 A * 3/1989 Scott ..... 165/134.1
4,853,667 A * 8/1989 Freimuth et al. ..... 336/192
4,887,522 A * 12/1989 Kuno et al. ..... 454/309
4,972,635 A * 11/1990 Wageman ..... 52/94
5,018,333 A * 5/1991 Bruhm ..... 52/741.4
D318,915 S * 8/1991 Chaney ..... D23/411
5,059,224 A * 10/1991 Kikkawa et al. ..... 96/19
5,085,057 A * 2/1992 Thompson et al. ..... 62/262
5,097,678 A * 3/1992 Aubuchon ..... 62/506
5,105,732 A * 4/1992 Sheu ..... 454/350
5,125,197 A * 6/1992 Fuchs ..... 52/202
5,155,957 A * 10/1992 Robertson et al. ..... 52/232
5,158,486 A * 10/1992 Tamame ..... 62/506
5,176,408 A * 1/1993 Pedersen ..... 285/42
5,183,435 A * 2/1993 Galvez ..... 454/18
5,257,641 A * 11/1993 Elsbury et al. ..... 137/79
5,307,849 A * 5/1994 Nelson ..... 150/165
5,330,386 A * 7/1994 Calandra ..... 454/341
5,341,860 A * 8/1994 Klein ..... 150/165
5,393,930 A * 2/1995 Wuertz ..... 174/483
D358,469 S * 5/1995 Mongeon ..... D24/129
5,456,050 A * 10/1995 Ward ..... 52/220.8
5,468,186 A * 11/1995 Bolton et al. ..... 454/202
5,474,185 A * 12/1995 Franke ..... 206/586
5,479,984 A * 1/1996 Easterbrook et al. ..... 165/96
5,545,685 A * 8/1996 Davis et al. ..... 524/490
5,685,977 A * 11/1997 Golston et al. ..... 210/232
D387,145 S * 12/1997 Knight ..... D23/354
D394,901 S * 6/1998 Governale et al. ..... D23/354
D404,096 S * 1/1999 Wiedner et al. ..... D21/701
D404,447 S * 1/1999 Wiedner et al. ..... D21/701
5,876,282 A * 3/1999 Kenny ..... 454/367
5,887,396 A * 3/1999 Thoreson ..... 52/232
5,890,959 A * 4/1999 Pettit et al. ..... 454/184
5,970,667 A * 10/1999 Thaler ..... 52/219
6,014,841 A * 1/2000 McCoy et al. ..... 52/19
6,031,717 A * 2/2000 Baddour et al. ..... 361/679.49
6,061,981 A * 5/2000 Nieves ..... 52/202
6,076,370 A * 6/2000 Da Silva ..... 62/262
6,112,490 A * 9/2000 Meyer ..... 52/407.3
6,115,250 A * 9/2000 Schmitt ..... 361/695
6,135,875 A * 10/2000 French ..... 454/184
6,174,232 B1 * 1/2001 Stoll et al. ..... 454/184
6,176,052 B1 * 1/2001 Takahashi ..... 52/232
6,181,557 B1 * 1/2001 Gatti ..... 361/695
6,230,418 B1 * 5/2001 Gomulinski ..... 34/140
6,397,617 B1 * 6/2002 Johnson ..... 62/259.1
6,401,474 B1 * 6/2002 Wigglesworth et al. ..... 62/259.1
6,520,175 B1 * 2/2003 Jones ..... 126/319
6,546,745 B2 * 4/2003 Torres et al. ..... 62/259.1
6,554,698 B2 * 4/2003 Kranzdorf et al. ..... 454/184
6,583,357 B2 * 6/2003 Rubenstein et al. ..... 174/360
6,587,340 B2 * 7/2003 Grouell et al. ..... 361/695
6,640,503 B1 * 11/2003 Evensen et al. ..... 52/60
6,705,833 B2 * 3/2004 Tam et al. ..... 415/146
6,729,586 B2 * 5/2004 Arguijo et al. ..... 248/65

(56) References Cited

U.S. PATENT DOCUMENTS

| | | | | |
|---|---|---|---|---|
| 6,745,491 | B1 * | 6/2004 | Hernandez-Zelaya | 34/140 |
| D494,265 | S * | 8/2004 | Snyder et al. | D23/393 |
| D494,670 | S * | 8/2004 | Snyder | D23/393 |
| D496,453 | S * | 9/2004 | Snyder et al. | D23/393 |
| 6,848,492 | B2 * | 2/2005 | Thomas | 160/368.1 |
| D507,344 | S * | 7/2005 | Anderson | D23/393 |
| 6,932,266 | B2 * | 8/2005 | Jones et al. | 229/199 |
| 6,938,683 | B2 * | 9/2005 | Lin | 165/121 |
| 6,969,799 | B2 * | 11/2005 | Snyder | 174/483 |
| 6,971,631 | B1 * | 12/2005 | Naughton | 251/212 |
| 6,998,530 | B2 * | 2/2006 | Snyder | 174/483 |
| 7,010,889 | B1 * | 3/2006 | Renfro | 52/219 |
| 7,025,086 | B2 * | 4/2006 | Maeda et al. | 137/512.1 |
| 7,082,730 | B2 * | 8/2006 | Monden et al. | 52/232 |
| D557,394 | S * | 12/2007 | Martin et al. | D23/355 |
| 7,373,962 | B2 * | 5/2008 | Oubichon | 150/154 |
| 7,511,955 | B2 * | 3/2009 | Yin | 361/695 |
| 7,535,709 | B2 * | 5/2009 | Fan et al. | 361/695 |
| 7,568,314 | B2 * | 8/2009 | Collins | 52/60 |
| D601,180 | S * | 9/2009 | Takeda | D16/235 |
| 7,784,234 | B2 * | 8/2010 | Warmolts et al. | 52/317 |
| 7,954,286 | B2 * | 6/2011 | Khan et al. | 52/219 |
| 8,057,161 | B2 * | 11/2011 | Seidler | 415/26 |
| 8,161,696 | B2 * | 4/2012 | Colwell et al. | 52/220.8 |
| 8,341,897 | B2 * | 1/2013 | Margarites | 52/198 |
| 8,460,075 | B2 * | 6/2013 | Mavroudis et al. | 454/275 |
| 8,528,493 | B1 * | 9/2013 | Ratigan | 114/221 R |
| 8,590,229 | B2 * | 11/2013 | Taylor et al. | 52/205 |
| 8,616,944 | B2 * | 12/2013 | Chambo et al. | 454/162 |
| 8,668,435 | B2 * | 3/2014 | Weisser et al. | 415/26 |
| D702,330 | S * | 4/2014 | Holslin | D23/286 |
| 2001/0004023 | A1 * | 6/2001 | Munzenberger et al. | 174/77 R |
| 2003/0233797 | A1 * | 12/2003 | Anderson | 52/218 |
| 2004/0168398 | A1 * | 9/2004 | Sakno et al. | 52/741.4 |
| 2005/0045506 | A1 * | 3/2005 | Boone | 206/320 |
| 2005/0055889 | A1 * | 3/2005 | Thaler | 52/58 |
| 2005/0150176 | A1 * | 7/2005 | Erekson | 52/58 |
| 2005/0246999 | A1 * | 11/2005 | Hoffman | 52/580 |
| 2006/0076425 | A1 * | 4/2006 | Demster | 236/49.3 |
| 2007/0101664 | A1 * | 5/2007 | Hoy et al. | 52/198 |
| 2007/0204945 | A1 * | 9/2007 | Ross | 150/165 |
| 2007/0210575 | A1 * | 9/2007 | Keiper | 285/31 |
| 2008/0047478 | A1 * | 2/2008 | Park et al. | 114/221 R |
| 2008/0113608 | A1 * | 5/2008 | Van Duren et al. | 454/237 |
| 2010/0081371 | A1 * | 4/2010 | Dinicolas | 454/275 |
| 2012/0129445 | A1 * | 5/2012 | Gleason | 454/322 |
| 2014/0080402 | A1 * | 3/2014 | Staelgraeve, II | 454/239 |

OTHER PUBLICATIONS

Clissold, Peter; Seamanship; http://www.splashmaritime.com.au/Marops/data/text/Seamantex/Introtex.htm; copyright 2008; relevent pages: p. 3.*

* cited by examiner

SWAMP COOLER BLOWER FAN HOLE COVER

BACKGROUND OF THE INVENTION (a) Field of the Invention

This invention relates to a cover for a swamp cooler and more particularly, but not by way of limitation, to a swamp cooler blower fan hole cover. The blower fan hole cover is used to cover one or more air intake holes in the sides of a swamp cooler blower fan housing and prevent heat loss from a building during winter months.

(b) Discussion of Prior Art

Heretofore, there have been a variety of different types of swamp cooler covers that slip over the swamp cooler housing. The covers are used during winter months and then removed when the cooler is in use. The subject swamp cooler blower fan hole cover is used specifically to cover one or more air intake holes in the side of the swamp cooler blower fan housing. The subject invention eliminates the need to buy and install a complete swamp cooler housing cover at a greater expense and requiring more time to install.

SUMMARY OF THE INVENTION

In view of the foregoing, it is a primary objective of the subject invention to provide an inexpensive and highly effective swamp cooler blower fan hole cover to prevent heat loss from a residential or commercial building and through the swamp cooler during winter months and when the swamp cooler isn't in operation.

Another object of the invention is the fan hole cover can be quickly installed to cover a fan hole opening in a side of a swamp cooler blower fan housing and then quickly remove the cover when the swamp cooler is in use during summer months.

Yet another object of the invention is it can include one, two or more fan hole covers having different dimensions for covering different sizes and shapes of fan hole openings in the swamp cooler housings.

The subject invention includes a thin sheet, flexible, cover member. The cover member can be made of heavy cardboard, plastic, sheet metal, and like thin sheet materials. The cover member is dimensioned to cover a fan hole in the side of a swamp cooler blower fan housing. The cover member includes two foldable side tabs, next to the periphery of the cover member, which are folded when the cover member is slipped under shaft bearing support arms attached to the sides of the fan hole. The cover member also includes a center hole with center hole tabs for receipt around a blower fan drive shaft mounted inside the swamp cooler blower fan housing. From the center hole of the cover member is a radius cut extending outwardly to the periphery of the cover member. Disposed on opposite sides of the radius cut are parallel drive shaft fold lines. The drive shaft fold lines are folded outwardly when the cover member is received around the drive shaft. For added efficiency, the periphery of the cover member can be taped to the side of the fan hole to prevent heat loss from around the side of the cover member.

These and other objects of the present invention will become apparent to those following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of the subject swamp cooler fan hole cover, and in which.

DETAILED DESCRIPTION OF THE PREFERRED EMBODIMENTS

Figure 1:
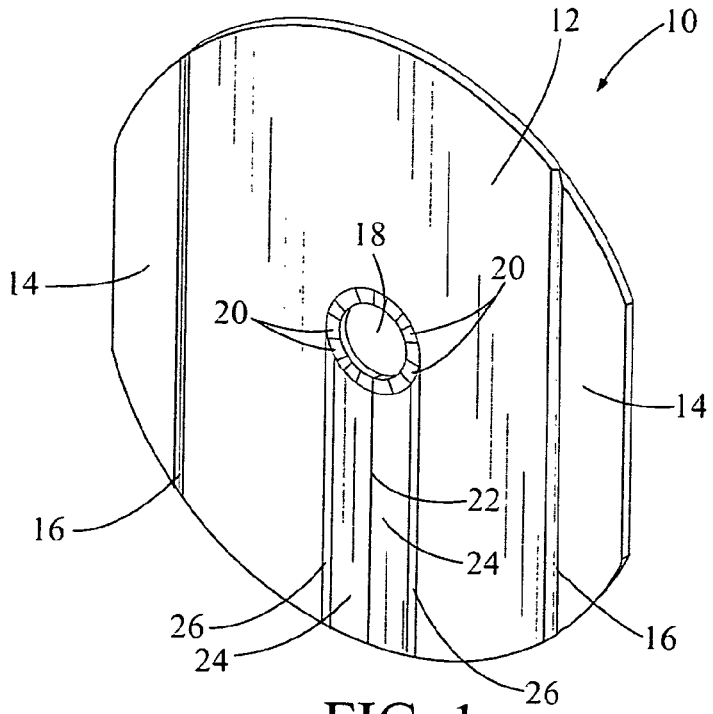
FIG. 1 is a perspective view on the subject swamp cooler blower fan hole cover.

In FIG. 1, a perspective view of the subject swamp cooler blower fan hole cover is shown and having general reference numeral 10. As mentioned above, the fan hole cover 10 can be constructed of light weight, flexible, heavy cardboard, plastic, metal, and similar thin sheet material.

The fan hole cover 10 includes a cover member 12 being annular in shape. The cover member will typically have a diameter in a range of 15 to 18 inches. But, it should be kept in mind, the cover member can have various geometric shapes and sizes for covering different sizes and shapes of blower fan holes.

The cover member 12 includes a pair of foldable side tabs 14 with score lines 16. The side tabs 14 are folded along the score lines 16 when the cover member 12 is installed next to the fan hole. The side tabs have a width in a range of 1 to 2 inches. Also, the cover member 12 includes a shaft center hole 18, which may or may not include center hole tabs 20 therearound and extending inwardly toward the center of the hole. The center hole and hole tabs have a diameter of approximately 1½ inches. Further and extending outwardly from the center hole 18 to the periphery of the cover member 12 is a radial cut 22. Disposed on opposite sides of the radial cut 22 are a pair of parallel drive shaft fold tabs 24 with fold lines 26. The drive shaft fold tabs are parallel and extend, outwardly from the opposite sides of the center hole and center hole tabs.

Figure 2:
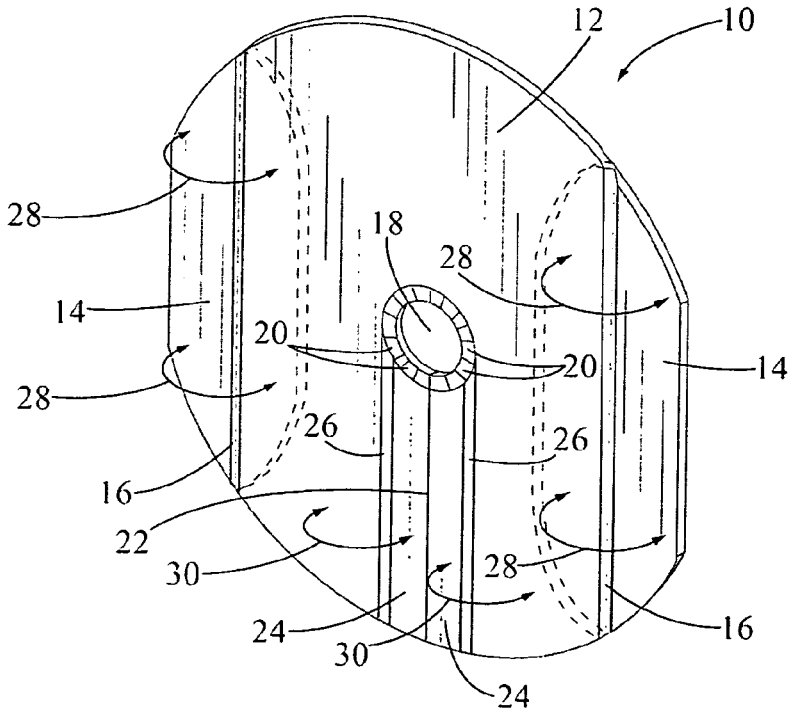
FIG. 2 is another perspective view of the fan hole cover illustrating a foldable movement, shown as arrows, of a pair of side fold tabs and a pair of drive shaft fold tabs. The tabs are folded when installing the fan hold cover next to a fan hole in a side of a swamp cooler blower fan housing.

In FIG. 2, another perspective view of the fan hole cover 10 is shown and illustrating a foldable movement, shown as arrows 28, of the pair of side tabs 14 on the score lines 16. Also, a foldable movement of the drive shaft fold tabs 24 on the fold lines 26 is shown using arrows 30.

Figure 3:
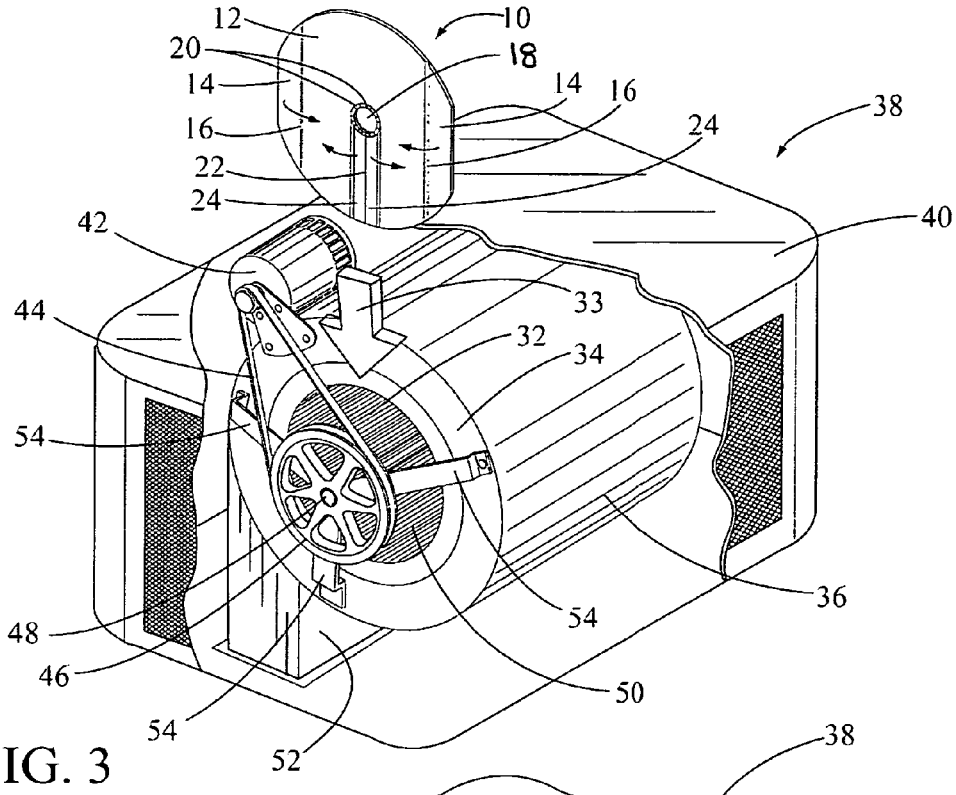
FIG. 3 is a perspective view of the fan hole cover positioned for covering the fan hole in the side of the swamp cooler blower fan housing.

In FIG. 3, a perspective view of the fan hole cover 10 is shown positioned, as indicated by larger arrow 33, for covering a fan hole 32 in a side 34 of a swamp cooler blower fan housing 36. The drawings don't illustrate the other side of the blower fan housing 36, which include a similar fan hole to be covered by the subject invention. The blower fan housing 36 is shown received inside a swamp cooler, having general reference numeral 38. The swamp cooler 38 is shown with a portion of a swamp cooler housing 40 cutaway. A drive motor 42 is shown mounted inside the housing 40 and with a drive belt 44 attached to a blower fan pulley 46 mounted on a blower fan drive shaft 48. The drive shaft 48 is used for driving a blower fan 50, which circulates air through an air discharge duct 52 for cooling a building. The drive shaft 48 is supported on the blower fan housing 36 using spaced apart, drive shaft support arms 54 attached to the side 34 of the housing 36.

Figure 4:
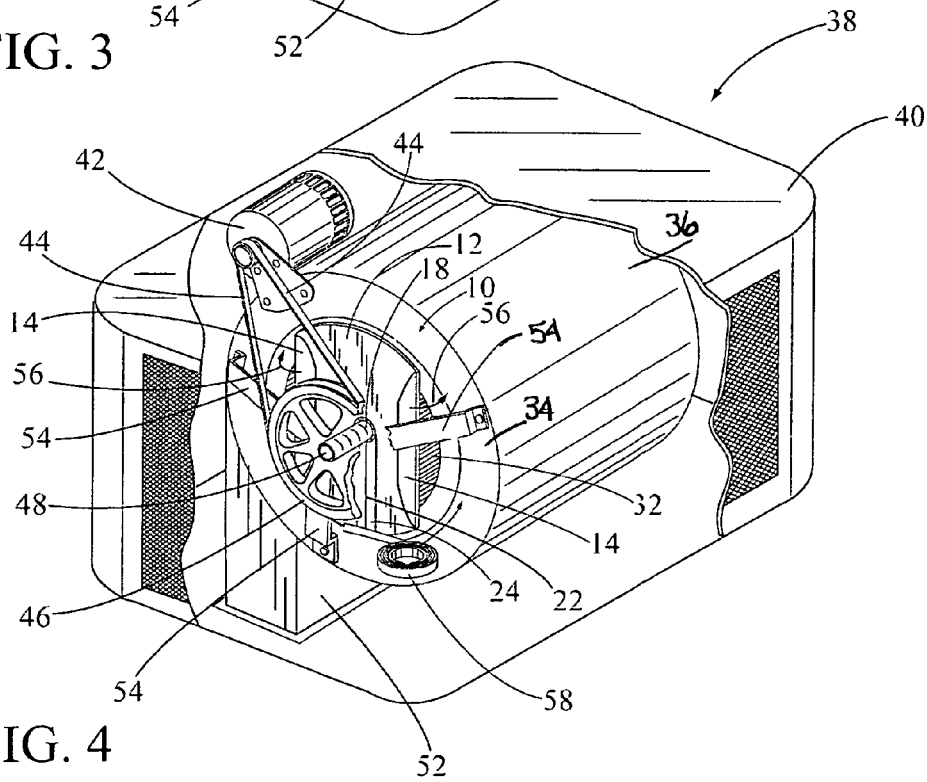
FIG. 4 is another perspective view of the fan hole cover, similar to FIG. 3, received around a blower fan drive shaft and the side fold tabs positioned to be folded against the side of the blower fan opening.

In FIG. 4, another perspective view of the blower fan hole cover 10 is shown and similar to FIG. 3. In this drawing, the radial cut 22 and drive shaft fold tabs 24 have been used to insert the center hole 18 around a portion of the drive shaft 48, with the center hole tabs 20 compressed against the sides of the shaft. Also, the two side tabs 14 have been folded back so that the cover member 12 can be inserted under the shaft support arms 54. When the cover member 12 is in place, as shown in this drawing, the side tabs 14 are folded back, as indicated by arrows 56, to complete the covering of the fan hole 32 by the cover member 12.

Also shown in this drawing is a roll of tape 58, which is used to tape the periphery of the cover member 12 to the side 34 of the blower fan housing 36. Also, the cover member 12 can include an adhesive therearound for securing the member to the side of the blower fan housing. This feature adds to the efficiency of the swamp cooler blower fan hole cover 10 and helps further prevent hot air from escaping out the fan hole 32 in the blower fan housing 36 during winter months.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The invention claimed is:

1. A swamp cooler blower fan hole cover used to prevent heat loss from a residential or commercial building and through a fan hole in a swamp cooler blower fan housing during winter months and when a swamp cooler isn't in operation, the fan hole cover designed to completely cover the fan hole, the fan hole cover comprising:

a thin sheet, flexible, cover member, the cover member annular in shape, the cover member is adapted for and dimensioned to cover the fan hole in a side of the blower fan housing;

a center hole, the center hole disposed in a center portion of the cover member, the center hole adapted for receipt around a blower fan drive shaft mounted inside the swamp cooler blower fan housing;

center hole tabs formed by radial slits disposed around a circumference of the center hole, the center hole tabs adapted for receipt against a portion of the blower fan drive shaft when the center hole is received around the drive shaft;

a vertical radius cut extending downwardly from the center hole to a periphery of the cover member;

a pair of parallel, vertical, foldable drive shaft fold tabs with folds formed as live hinges positioned parallel to the radius cut and each drive shaft fold tab having an edge formed by the radius cut, when in an unfolded position, the drive shaft fold tabs having sides disposed next to the radius cut, and when in a folded position, the drive shaft fold tabs provide a space therebetween adapted for receiving the drive shaft therethrough and next to the center hole and center hold tabs, a top portion of the drive shaft fold tabs having center hole tabs thereon;

a pair of parallel, vertical, foldable side tabs, the foldable side tabs formed along the periphery of the cover member and on opposite sides of the cover member, whereby when the side tabs are folded next to a portion of the cover member, the side tabs adapted for receipt with the cover member under shaft bearing support arms attached to a side of the fan hole, whereby when the side tabs are unfolded, the cover member is received under the shaft bearing support arms and next to the fan hole for completing the covering of the fan hole; and wherein the fan hole cover is made from a material selected from the group consisting of sheet metal, cardboard and plastic.

2. The fan hole cover as described in claim 1 further including tape for securing the periphery of the cover member to the side of the fan hole cover.

* * * * *